US010309351B2

(12) United States Patent
Inuzuka et al.

(10) Patent No.: US 10,309,351 B2
(45) Date of Patent: Jun. 4, 2019

(54) INTAKE SYSTEM COMPONENT OF INTERNAL COMBUSTION ENGINE AND METHOD FOR MANUFACTURING INTAKE SYSTEM COMPONENT OF INTERNAL COMBUSTION ENGINE

(71) Applicant: TOYOTA BOSHOKU KABUSHIKI KAISHA, Aichi-ken (JP)

(72) Inventors: Yoshinori Inuzuka, Nishio (JP); Ryusuke Kimura, Ichinomiya (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 169 days.

(21) Appl. No.: 15/677,730

(22) Filed: Aug. 15, 2017

(65) Prior Publication Data

US 2018/0058395 A1 Mar. 1, 2018

(30) Foreign Application Priority Data

Aug. 29, 2016 (JP) ..... 2016-167241

(51) Int. Cl.
*F02M 35/14* (2006.01)
*F02M 35/024* (2006.01)
*F02M 35/02* (2006.01)

(52) U.S. Cl.
CPC .. *F02M 35/02458* (2013.01); *F02M 35/0201* (2013.01); *F02M 35/02408* (2013.01)

(58) Field of Classification Search
CPC ..... F02M 35/0201; F02M 35/02408; F02M 35/02458
USPC ..... 55/385.3; 123/198 E
See application file for complete search history.

(56) References Cited

U.S. PATENT DOCUMENTS

| | | | | |
|---|---|---|---|---|
| 6,383,268 | B2 * | 5/2002 | Oda | B01D 46/0005 55/385.3 |
| 7,879,124 | B2 * | 2/2011 | Uemura | B01D 46/0036 156/73.5 |
| 2007/0175187 | A1 * | 8/2007 | Kopec | B01D 46/0005 55/385.3 |
| 2010/0050980 | A1 * | 3/2010 | Sasano | F02M 35/0203 123/198 E |
| 2014/0318092 | A1 * | 10/2014 | Rieger | B01D 46/0001 55/511 |

FOREIGN PATENT DOCUMENTS

JP 2002-021660 1/2002

* cited by examiner

*Primary Examiner* — Frank M Lawrence, Jr.
(74) *Attorney, Agent, or Firm* — Greenblum & Bernstein, P.L.C.

(57) ABSTRACT

An intake system component of an internal combustion engine includes a porous material product and a resin molded portion. The porous material product is formed from a porous material and includes an outer edge and a general portion. The resin molded portion encompasses the outer edge and is formed integrally with the porous material product. The general portion is located outside the resin molded portion. The outer edge has a lower filling density than the general portion.

5 Claims, 3 Drawing Sheets

INTAKE SYSTEM COMPONENT OF INTERNAL COMBUSTION ENGINE AND METHOD FOR MANUFACTURING INTAKE SYSTEM COMPONENT OF INTERNAL COMBUSTION ENGINE

BACKGROUND OF THE INVENTION

The present invention relates to an intake system component of an internal combustion engine including a porous material product, which is formed from a porous material, and a resin molded portion, which encompasses an outer edge of the porous material product and which is formed integrally with the porous material product, and to a method for manufacturing the intake system component of the internal combustion engine.

Japanese Laid-Open Patent Publication No. 2002-21660 describes an example of an air cleaner for a vehicle internal combustion engine serving as one type of an intake system component. The air cleaner includes a porous material product formed from a porous material such as filter paper, nonwoven fabric, or open-cell sponge. The porous material product forms a wall of a housing of the air cleaner. The publication discloses insertion of the porous material product when molding a resin molded portion of the housing.

When forming the wall of the housing with the porous material product, the porous material is thermally pressed prior to the insert-molding. The thermal pressing forms the porous material into a predetermined shape and increases the filling density. This increases the rigidity of the wall. However, the amount of the molten resin with which the outer edge of the porous material product is impregnated is reduced when insert-molding is performed. Thus, the strength bonding the porous material product with the resin molded portion may become low, and the outer edge of the porous material product may be separated from the resin molded portion.

SUMMARY OF THE INVENTION

It is an object of the present invention to provide an intake system component of an internal combustion engine that increases the strength bonding a porous material product with a resin molded portion and a method for manufacturing the intake system component of the internal combustion engine.

To achieve the above object, an intake system component of an internal combustion engine includes a porous material product and a resin molded portion. The porous material product is formed from a porous material and includes an outer edge and a general portion. The resin molded portion encompasses the outer edge and is formed integrally with the porous material product. The general portion is located outside the resin molded portion. The outer edge has a lower filling density than the general portion.

In the structure, the outer edge of the porous material product has a lower filling density than the general portion. When molding the resin molded portion, this easily impregnates the outer edge with molten resin and increases the anchor effect and the strength bonding the porous material product with the resin molded portion.

Further, to achieve the above object, a method for manufacturing an intake system component of an internal combustion engine is provided. The intake system component of the internal combustion engine includes a porous material product and a resin molded portion. The porous material product is formed from a porous material and includes an outer edge and a general portion. The resin molded portion encompasses the outer edge and is formed integrally with the porous material product. The method includes forming the porous material product that includes the general portion and a low-density portion by thermally pressing the porous material. The low-density portion has a lower filling density than the general portion. The method further includes molding the resin molded portion by injecting molten resin into a cavity of a mold with at least a distal portion of the low-density portion inserted into the cavity.

In this method, the porous material is thermally pressed in the thermal pressing step to form the porous material product including the general portion and the low-density portion. Further, molten resin is injected into the cavity of the mold in the resin molding step to mold the resin molded portion that encompasses at least the distal portion of the low-density portion of the porous material product. The low-density portion has a lower filling density than the general portion. This easily impregnates the outer edge of the porous material product with molten resin and increases the anchor effect and the strength bonding the porous material product with the resin molded portion.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment will now be described with reference to FIGS. 1 to 4.

Figure 1:
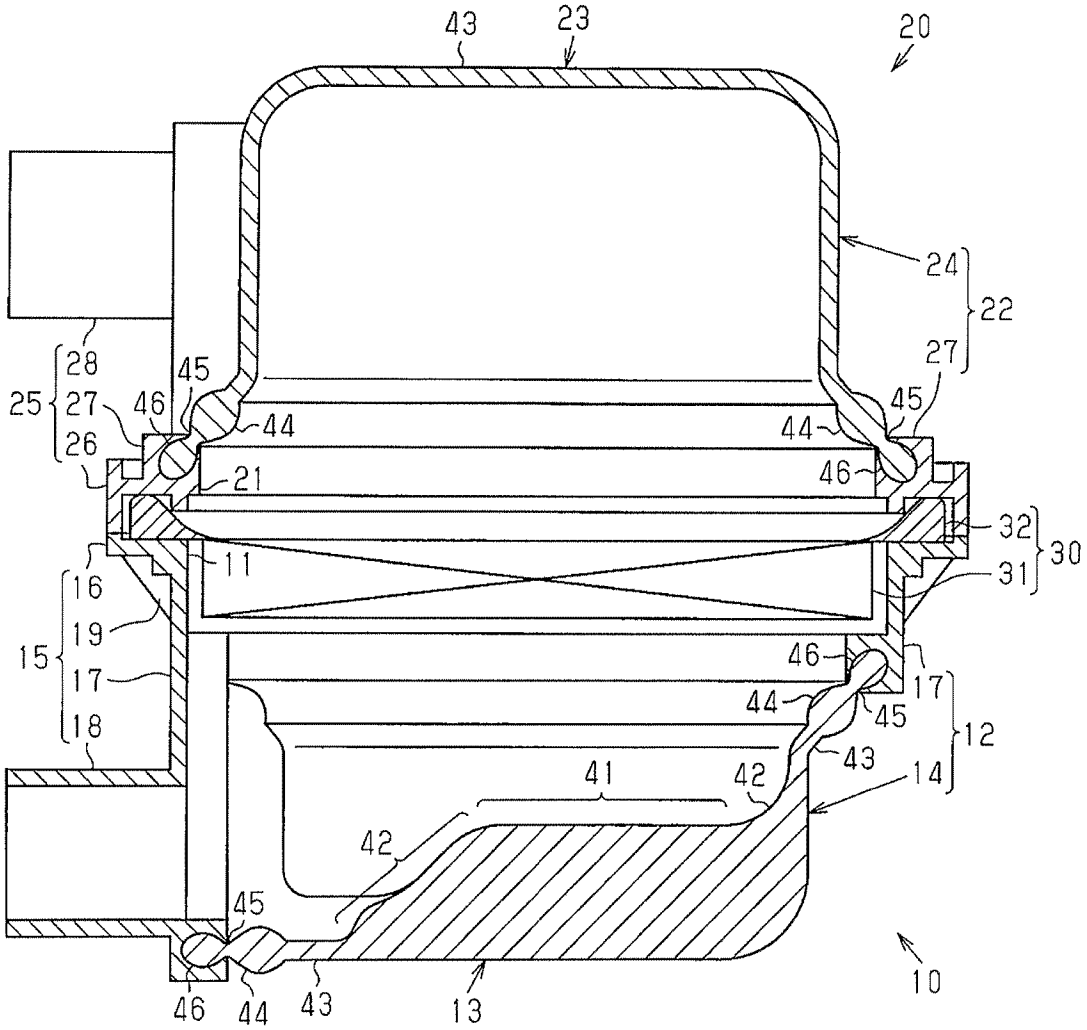
FIG. 1 is a cross-sectional view showing the structure of an air cleaner serving as an intake system component in one embodiment of an intake system component of an internal combustion engine.

Referring to FIG. 1, an air cleaner is arranged in an intake passage of a vehicle internal combustion engine. The air cleaner includes a first housing 10 having an inlet 18, a second housing 20 having an outlet 28, and a filter element 30. The filter element 30 is located between an upper opening 11 of the first housing 10 and a lower opening 21 of the second housing 20 that opposes the upper opening 11.

The first housing 10 includes a peripheral wall 12, which surrounds the upper opening 11, and a bottom wall 13. A ring-shaped flange 16 projects toward the outer side from the periphery of the upper opening 11. The inlet 18 is tubular and projects from an outer surface of the peripheral wall 12.

The second housing 20 includes a peripheral wall 22 that surrounds the lower opening 21 and a top wall 23. A ring-shaped flange 26 projects toward the outer side from the periphery of the lower opening 21. The outlet 28 is tubular and projects from an outer surface of the peripheral wall 22.

The filter element 30 includes a filtration portion 31, which is formed by pleating a filter medium sheet such as filter paper or nonwoven fabric, and a ring-shaped seal 32, which is located on an outer edge of the filtration portion 31.

The seal 32 is held between the flange 16 of the first housing 10 and the flange 26 of the second housing 20 to seal the gap between the first housing 10 and the second housing 20.

The structure of the first housing 10 will now be described in detail.

The first housing 10 includes a nonwoven fabric product 14, which serves as a porous material product, and a resin molded portion 15. The nonwoven fabric product 14 is formed from a nonwoven fabric sheet serving as a porous material. The resin molded portion 15 is formed from a hard resin material and encompasses an outer edge 46 of the nonwoven fabric product 14. The nonwoven fabric product 14 is formed integrally with the resin molded portion 15 through insert-molding.

The resin molded portion 15 includes the flange 16, the inlet 18, a resin wall 17, and a plurality of ribs 19. The resin wall 17 forms part of the peripheral wall 12 and is located between the flange 16 and the inlet 18. The ribs 19 project from an outer surface of the resin wall 17 and the flange 16 and are spaced apart from one another in the circumferential direction.

The nonwoven fabric product 14 forms the entire bottom wall 13 and the part of the peripheral wall 12 excluding the resin molded portion 15.

The nonwoven fabric product 14 is formed from known core-sheath composite fibers each including a core (not shown) formed from, for example, polyethylene terephthalate (PET) and a sheath (not shown) formed from denatured PET having a lower melting point than the PET fiber.

The nonwoven fabric product 14 is molded by thermally pressing a nonwoven fabric sheet 40 (refer to FIG. 3A) having a thickness of, for example, 30 mm to 100 mm.

The nonwoven fabric product 14 includes a thick portion 41, a general portion 43, and a thickness varying portion 42. The general portion 43 of the nonwoven fabric sheet 40 has a higher compression degree, or fiber filling density (hereinafter referred to as the filling density), than the thick portion 41. The thickness varying portion 42 is located between the thick portion 41 and the general portion 43 and is gradually reduced in thickness from the thick portion 41 toward the general portion 43. The thick portion 41 and the relatively thick part of the thickness varying portion 42 function to deaden the intake noise (hereinafter referred to as noise deadening effect).

The thick portion 41 extends from a central part of the bottom wall 13 of the first housing 10 to the peripheral wall 12 that is located at the opposite side (right side as viewed in FIG. 1) of the inlet 18 relative to the central part. It is preferred that the thick portion 41 have a thickness of, for example, 5 mm to 50 mm to avoid enlargement of the nonwoven fabric product 14 and achieve the noise deadening effect.

The general portion 43 extends over the entire outer edge of the thickness varying portion 42. It is preferred that the general portion 43 have a thickness of, for example, 1 mm to 3 mm to facilitate formation of the nonwoven fabric product 14 and ensure the rigidity of the nonwoven fabric product 14.

The outer edge 46 is formed over the entire outer edge of the general portion 43 with a buffer portion 44 and a compressed portion 45 located in between. The buffer portion 44 is located adjacent to the resin molded portion 15 at the outer side of the resin molded portion 15. The compressed portion 45 is located at the boundary between inside and outside of the resin molded portion 15.

The maximum thickness of the buffer portion 44 and the outer edge 46 is larger than the thickness of the general portion 43. The buffer portion 44 and the outer edge 46 have a lower filling density than the general portion 43. The compressed portion 45 is more compressed than the buffer portion 44 and the outer edge 46, and the compressed portion 45 has a higher filling density than the buffer portion 44 and the outer edge 46.

The structure of the second housing 20 will now be described in detail.

Figure 2:
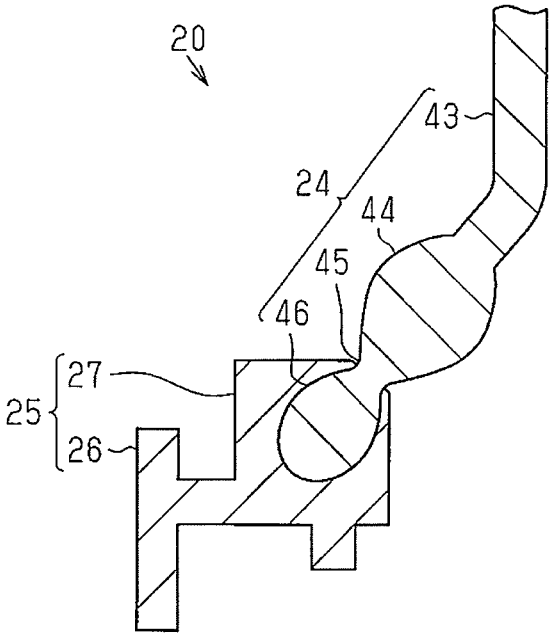
FIG. 2 is a partially enlarged cross-sectional view of FIG. 1.

As shown in FIGS. 1 and 2, the second housing 20 includes a nonwoven fabric product 24 serving as a porous material product and a resin molded portion 25. The nonwoven fabric product 24 is formed from a nonwoven fabric sheet, which serves as a porous material. The resin molded portion 25 is formed from a hard resin material and encompasses the outer edge 46 of the nonwoven fabric product 24. The nonwoven fabric product 24 is formed integrally with the resin molded portion 25 through insert-molding.

The resin molded portion 25 includes the flange 26, the outlet 28, a resin wall 27, and a plurality of ribs (not shown). The resin wall 27 forms part of the peripheral wall 22 and is located between the flange 26 and the outlet 28. The ribs project from an outer surface of the resin wall 27 and the flange 26 and are spaced apart from one another in the circumferential direction.

The nonwoven fabric product 24 includes the entire top wall 23 and the part of the peripheral wall 22 excluding the resin molded portion 25.

The nonwoven fabric product 24 is formed by thermally pressing the nonwoven fabric sheet 40 in the same manner as the nonwoven fabric product 14 of the first housing 10.

The nonwoven fabric product 24 includes the entire top wall 23 and the general portion 43. The general portion 43 forms part of the peripheral wall 22 that is continuous with the top wall 23. The nonwoven fabric product 24 does not include the thick portion 41 and the thickness varying portion 42. It is preferred that the general portion 43 have a thickness of, for example, 1 mm to 3 mm to facilitate formation of the nonwoven fabric product 24 and ensure the rigidity of the nonwoven fabric product 24.

In the same manner as the nonwoven fabric product 14 of the first housing 10, the outer edge 46 is formed over the entire outer edge of the general portion 43 with the buffer portion 44 and the compressed portion 45 located in between.

The method for manufacturing the first housing 10 and the second housing 20 through insert-molding will now be described. The first housing 10 and the second housing 20 are manufactured by basically the same method. Thus, the method for manufacturing the second housing 20 will be described instead of the method for manufacturing the first housing 10.

Thermal Pressing Step

Figure 3A:
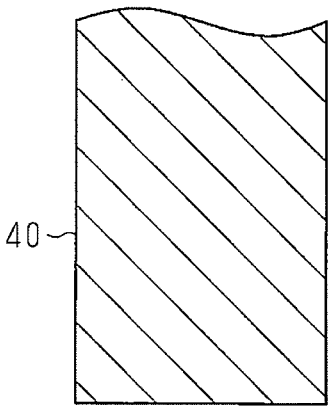
FIG. 3A is a cross-sectional view showing a nonwoven fabric sheet prior to thermal pressing.
Figure 3B:
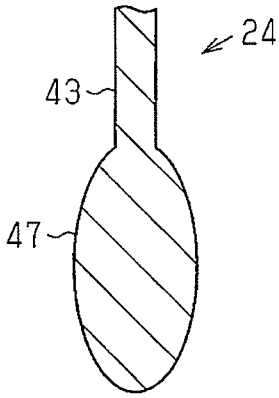
FIG. 3B is a cross-sectional view showing the nonwoven fabric sheet (nonwoven fabric material product) subsequent to thermal pressing.

First, referring to FIGS. 3A and 3B, the nonwoven fabric sheet 40 is thermally pressed to form the nonwoven fabric product 24 including the general portion 43 and a low-density portion 47. The low-density portion 47 is located at the outer edge of the general portion 43 and has a lower filling density than the general portion 43. The low-density portion 47 of the present embodiment has an oval cross section. However, the low-density portion 47 may have other cross-sectional shapes such as a rectangular shape.

Resin Molding Step

Figure 4:
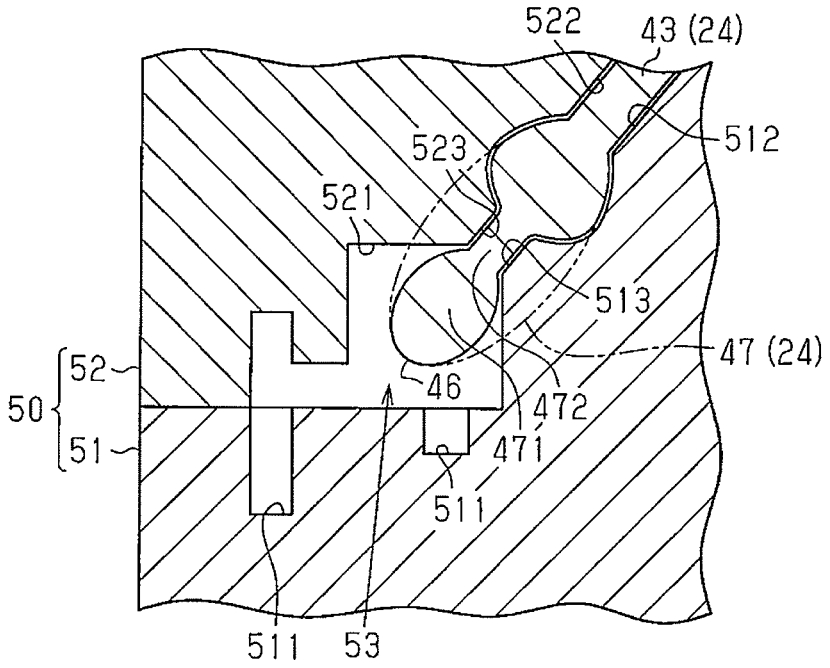
FIG. 4 is a cross-sectional view mainly illustrating a resin molding step in the embodiment and showing a low-density portion of the nonwoven fabric material product and a mold.

Subsequently, as shown in FIG. 4, the nonwoven fabric product 24 is placed in a mold 50.

The mold 50 includes a first mold 51 and a second mold 52. Grooves 511 and 521 defining a cavity 53 are formed in parting surfaces of the first mold 51 and the second mold 52.

Accommodation portions 512 and 522 that accommodate the general portion 43 of the nonwoven fabric product 24 are defined in the parting surfaces. Further, clamping portions 513 and 523 that clamp the low-density portion 47 are formed between the grooves 511 and 521 and the accommodation portions 512 and 522 in the parting surfaces.

The mold 50 is closed with a distal portion 471 of the low-density portion 47 of the nonwoven fabric product 24 inserted into the cavity 53 of the mold 50. The clamping portions 513 and 523 of the mold 50 compress a continuous portion 472 that is continuous with the distal portion 471 of the low-density portion 47. This forms the outer edge 46 with the distal portion 471 of the low-density portion 47.

In this state, molten resin is injected into the cavity 53. This forms the resin molded portion 25 as shown in FIG. 2. The low-density portion 47 has a lower filling density than the general portion 43. This easily impregnates the outer edge 46 with molten resin and increases the anchor effect and the strength bonding the nonwoven fabric products 14 and 24 with the resin molded portions 15 and 25.

Further, the clamping portions 513 and 523 of the mold 50 compress the continuous portion 472. This avoids situations in which the molten resin in the cavity 53 flows toward a basal part of the low-density portion 47, that is, the buffer portion 44.

When opening the mold 50, the part that was compressed by the clamping portions 513 and 523 returns to its original shape. As shown in FIG. 2, this forms the buffer portion 44, which has a lower filling density than the general portion 43, between the resin molded portion 25 of the nonwoven fabric product 24 and the general portion 43. Further, the compressed portion 45 is formed at the boundary between the inside and outside of the resin molded portion 15.

The intake system component of the internal combustion engine and the method for manufacturing the intake system component of the internal combustion engine of the present embodiment have the advantages described below.

(1) The housings 10 and 20 of the air cleaner of the internal combustion engine respectively include the nonwoven fabric products 14 and 24, which are formed from nonwoven fabric, and the resin molded portions 15 and 25, which encompass the outer edges 46 of the nonwoven fabric products 14 and 24 and are formed integrally with the nonwoven fabric products 14 and 24. The outer edges 46 located inside the resin molded portions 15 and 25 have a lower filling density than the general portion 43 located outside the resin molded portions 15 and 25 of the nonwoven fabric products 14 and 24.

In such a structure, the filling density of the outer edges 46 of the nonwoven fabric products 14 and 24, that is, the fiber filling density is lower than the filling density of the general portion 43. This reduces the amount of the molten resin with which the outer edges 46 are impregnated when molding the resin molded portion 15 and increases the anchor effect and the strength bonding the nonwoven fabric product 14 with the resin molded portion 15.

(2) The nonwoven fabric molded product 14 includes the buffer portion 44 having a lower filling density than the general portion 43. The buffer portion 44 is located between the resin molded portion 15 and the general portion 43.

The general portion 43 of the nonwoven fabric product 14 has a high filling density. Thus, when external force such as vibration moves the general portion 43 relative to the resin molded portion 15, stress tends to concentrate at the resin molded portion 15 that encompasses the outer edge 46. This may cause separation or breakage of the resin molded portion 15.

In this regard, in the above structure, the buffer portion 44 is formed in the nonwoven fabric product 14. Thus, the buffer portion 44 absorbs the external force transmitted between the general portion 43 and the resin molded portion 15. This allows for movement of the general portion 43 relative to the resin molded portion 15 and limits separation and breakage of the resin molded portion 15.

(3) The nonwoven fabric sheet 40 is thermally pressed to form the nonwoven fabric products 14 and 24 that include the general portion 43 and the low-density portion 47, which has a lower filling density than the general portion 43 (thermal pressing step). Further, molten resin is injected into the cavity 53 with the distal portions 471 of the low-density portions 47 of the nonwoven fabric products 14 and 24 inserted into the cavity 53 of the mold 50 to mold the resin molded portions 15 and 25 (resin molding step).

In this method, the nonwoven fabric sheet 40 is thermally pressed in the thermal pressing step to form the nonwoven fabric products 14 and 24 including the general portion 43 and the low-density portion 47. Further, molten resin is injected into the cavity 53 of the mold 50 in the resin molding step to mold the resin molded portions 15 and 25 that encompass the distal portions 471 of the low-density portions 47 of the nonwoven fabric products 14 and 24. The low-density portion 47 has a lower filling density than the general portion 43. This easily impregnates the outer edges 46 of the nonwoven fabric products 14 and 24 with molten resin and increases the anchor effect and the strength bonding the nonwoven fabric products 14 and 24 with the resin molded portions 15 and 25.

(4) In the resin molding step, the continuous portion 472 that is continuous with the distal portion 471 is compressed by the mold 50 with the distal portion 471 of the low-density portion 47 of each of the nonwoven fabric products 14 and 24 inserted into the cavity 53 of the mold 50.

In this method, the continuous portion 472 is compressed by the mold 50 in the resin molding step. When opening the mold 50, the part that was compressed by the mold 50 returns to its original shape. This forms the buffer portion 44 having a lower filling density than the general portion 43 between the resin molded portions 15 and 25 of the nonwoven fabric products 14 and 24 and the general portion 43. Thus, the buffer portion 44 is easily formed.

Modified Examples

It should be apparent to those skilled in the art that the present invention may be embodied in many other specific forms without departing from the spirit or scope of the invention. Particularly, it should be understood that the present invention may be embodied in the following forms.

The nonwoven fabric product 24 of the second housing 20 may include the thick portion 41. Additionally, the thick portion 41 may be omitted from the nonwoven fabric product 14 of the first housing 10.

Water-resistant films may be applied to the outer sides of the nonwoven fabric products 14 and 24. In this case, a nonwoven fabric product can be formed by thermally pressing a nonwoven fabric sheet 40 including the film applied to one of the surfaces of the nonwoven fabric sheet 40. Even in this case, molten resin is easily impregnated in the resin molding step through the inner surface of each of the nonwoven fabric products 14 and 24, that is, surface opposite to the film. This increases the anchor effect and the strength bonding the nonwoven fabric product 14 and the resin molded portion 15.

The nonwoven fabric products 14 and 24 do not need to include the buffer portions 44. In this case, the size of the low-density portion 47 needs to be set so that the entire low-density portion 47 is inserted into the cavity 53.

A porous material product may be formed from, for example, a porous material other than the nonwoven fabric sheet 40 such as open-cell sponge.

The present invention may be applied to an intake system component other than an air cleaner, for example, an intake duct.

The present examples and embodiments are to be considered as illustrative and not restrictive, and the invention is not to be limited to the details given herein, but may be modified within the scope and equivalence of the appended claims.

The invention claimed is:

1. An intake system component of an internal combustion engine, the intake system component comprising:

a porous material product formed from a porous material and including an outer edge and a general portion; and a resin molded portion encompassing the outer edge and formed integrally with the porous material product, wherein the general portion is located outside the resin molded portion, and the outer edge has a lower filling density than the general portion.

2. The intake system component according to claim 1, wherein the porous material product further includes a buffer portion located between the resin molded portion and the general portion, and the buffer portion has a lower filling density than the general portion.

3. The intake system component according to claim 1, wherein the intake system component of the internal combustion engine includes a housing of an air cleaner, the housing includes a periphery defining an opening, and the resin molded portion includes a flange located on the periphery of the housing.

4. A method for manufacturing an intake system component of an internal combustion engine, wherein the intake system component includes a porous material product formed from a porous material and including an outer edge and a general portion, and a resin molded portion encompassing the outer edge and formed integrally with the porous material product, the method comprising:

forming the porous material product that includes the general portion and a low-density portion by thermally pressing the porous material, wherein the low-density portion has a lower filling density than the general portion; and molding the resin molded portion by injecting molten resin into a cavity of a mold with at least a distal portion of the low-density portion inserted into the cavity.

5. The method according to claim 4, wherein the low-density portion includes the distal portion and a continuous portion that is continuous with the distal portion, and the method further comprises compressing the continuous portion by the mold with the distal portion of the low-density portion inserted into the cavity of the mold.

* * * * *